US008291711B2

(12) United States Patent
Chokshi et al.

(10) Patent No.: US 8,291,711 B2
(45) **Date of Patent: *Oct. 23, 2012**

(54) FLOW SLEEVE IMPINGEMENT COOLING BAFFLES

(75) Inventors: Jaisukhlal V. Chokshi, Palm Beach Gardens, FL (US); Craig F. Smith, Ashford, CT (US); Carlos G. Figueroa, Wellington, FL (US); Larry C. George, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 1124 days.

This patent is subject to a terminal disclaimer.

(21) Appl. No.: 12/179,671

(22) Filed: Jul. 25, 2008

(65) Prior Publication Data

US 2010/0031666 A1 Feb. 11, 2010

(51) Int. Cl.
*F02C 1/00* (2006.01)

(52) U.S. Cl. ..... 60/772; 60/758; 60/760

(58) Field of Classification Search ..... 60/39.23, 60/752, 754, 755, 756, 757, 758, 759, 760, 60/772, 804

See application file for complete search history.

(56) References Cited

U.S. PATENT DOCUMENTS

| | | | | |
|---|---|---|---|---|
| 4,339,925 | A | 7/1982 | Eggmann et al. | |
| 5,363,654 | A | 11/1994 | Lee | |
| 5,388,412 | A | 2/1995 | Schulte-Werning et al. | |
| 5,467,815 | A | 11/1995 | Haumann et al. | |
| 5,533,864 | A | 7/1996 | Nomoto et al. | |
| 5,586,866 | A | 12/1996 | Wettstein | |
| 5,782,294 | A | 7/1998 | Froemming et al. | |
| 6,000,908 | A | 12/1999 | Bunker | |
| 6,484,505 | B1 | 11/2002 | Brown et al. | |
| 6,701,714 | B2 | 3/2004 | Burd et al. | |
| 6,711,900 | B1 * | 3/2004 | Patel et al. | 60/752 |
| 6,810,673 | B2 | 11/2004 | Snyder | |
| 6,837,053 | B2 | 1/2005 | Tiemann | |
| 6,925,808 | B2 | 8/2005 | Tiemann | |
| 7,270,175 | B2 | 9/2007 | Mayer et al. | |
| 7,278,256 | B2 * | 10/2007 | Norris et al. | 60/204 |
| 7,707,835 | B2 * | 5/2010 | Lipinski et al. | 60/752 |

* cited by examiner

*Primary Examiner* — Ehud Gartenberg
*Assistant Examiner* — Arun Goyal
(74) *Attorney, Agent, or Firm* — Kinney & Lange, P.A.

(57) ABSTRACT

A combustor assembly for a turbine engine includes a combustor liner, a flow sleeve and a baffle ring. The flow sleeve surrounds the combustor liner. An annulus is formed between the flow sleeve and the combustor liner. A plurality of row of cooling holes are formed in the flow sleeve. The baffle ring radially surrounds the combustor liner and is located in the annulus.

16 Claims, 4 Drawing Sheets

FLOW SLEEVE IMPINGEMENT COOLING BAFFLES

BACKGROUND

The present invention relates to a combustor assembly of a gas turbine engine. More specifically, the present invention relates to an apparatus and method of cooling a combustor liner of a gas turbine engine.

A gas turbine engine extracts energy from a flow of hot combustion gases. Compressed air is mixed with fuel in a combustor assembly of the gas turbine engine, and the mixture is ignited to produce hot combustion gases. The hot gases flow through the combustor assembly and into a turbine where energy is extracted.

Conventional gas turbine engines use a plurality of combustor assemblies. Each combustor assembly includes a fuel injection system, a combustor liner and a transition duct. Combustion occurs in the combustion liner. Hot combustion gases flow through the combustor liner and the transition duct into the turbine.

The combustor liner, transition duct and other components of the gas turbine engine are subject to these hot combustion gases. Current design criteria require that the temperature of the combustor liner be kept within its design parameters by cooling it. One way to cool the combustor liner is impingement cooling a surface wall of the liner.

In impingement cooling of a combustor liner, the front side (inner surface) of the combustor liner is exposed to the hot gases, and a jet-like flow of cooling air is directed towards the backside wall (outer surface) of the combustor liner. After impingement, the "spent air" (i.e. air after impingement) flows generally parallel to the component.

Gas turbine engines may use impingement cooling to cool combustor liners and transition ducts. In such arrangements, the combustor liner is surrounded by a flow sleeve, and the transition duct is surrounded by an impingement sleeve. The flow sleeve and the impingement sleeve are each formed with a plurality of rows of cooling holes.

A first flow annulus is created between the flow sleeve and the combustor liner. The cooling holes in the flow sleeve direct cooling air jets into the first flow annulus to impinge on the combustor liner and cool it. After impingement, the spent air flows axially through the first flow annulus in a direction generally parallel to the combustor liner.

A second flow annulus is created between the transition duct and the impingement sleeve. The holes in the impingement sleeve direct cooling air into the second flow annulus to impinge on the transition duct and cool it. After impingement, the spent air flows axially through the second flow annulus.

The combustor liner and the transition duct are connected, and the flow sleeve and the impingement sleeve are connected, so that the first flow annulus and the second flow annulus create a continuous flow path. That is, spent air from the second flow annulus continues into the first flow annulus. This flow from the second flow annulus creates cross flow effects on cooling air jets of the flow sleeve and may reduce the effectiveness and efficiency of these cooling air jets. For example, flow through the second flow annulus may bend the jets entering through the flow sleeve, reducing the heat transferring effectiveness of the jets or completely preventing the jets from reaching the surface of the combustor liner. This is especially a problem with regard to the first row of flow sleeve cooling holes adjacent the impingement sleeve.

BRIEF SUMMARY OF THE INVENTION

A combustor assembly for a turbine includes a combustor liner surrounded by a flow sleeve formed with a plurality of holes. A first flow annulus is formed between the combustor liner and the flow sleeve. Hot combustion gases flow through the combustor liner to a turbine. The combustor liner must be cooled to keep its temperature with the design specifications. One technique to cool the combustor liner is impingement cooling.

The baffle ring radially surrounds the combustor liner and is located in the annulus. The baffle ring directs air onto the combustor liner to cool it. The baffle ring may be added to a new or existing gas turbine assembly to provide efficient cooling flow to the combustor liner and improve impingement cooling. Compared to other impingement assemblies, the baffle ring has a reduced the part-count, lower cost, and a reduced potential for foreign object damage in the combustor assembly.

DETAILED DESCRIPTION

Figure 1A:
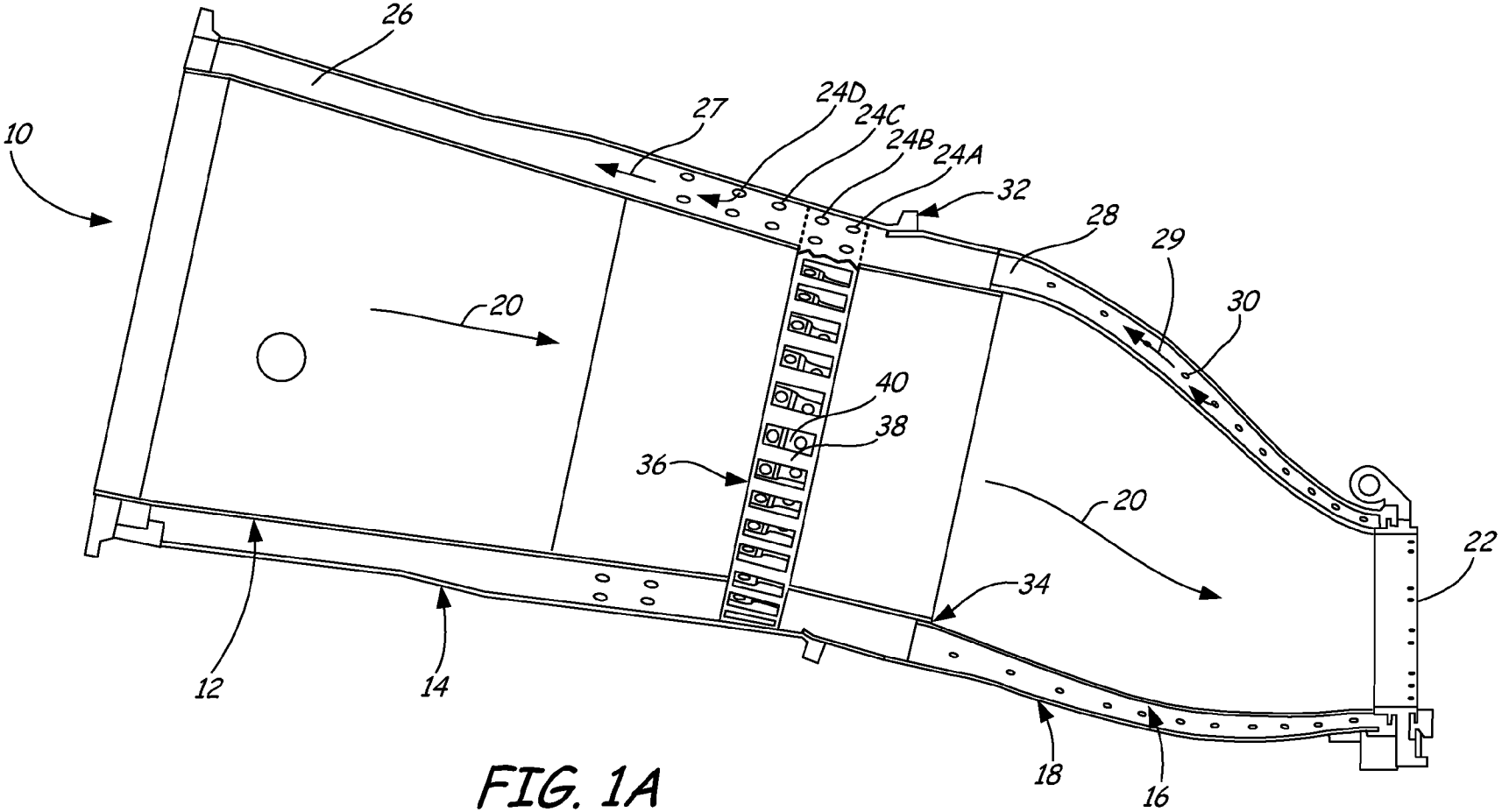
FIG. 1A is a cross section of a combustor assembly with a baffle ring.
Figure 1B:
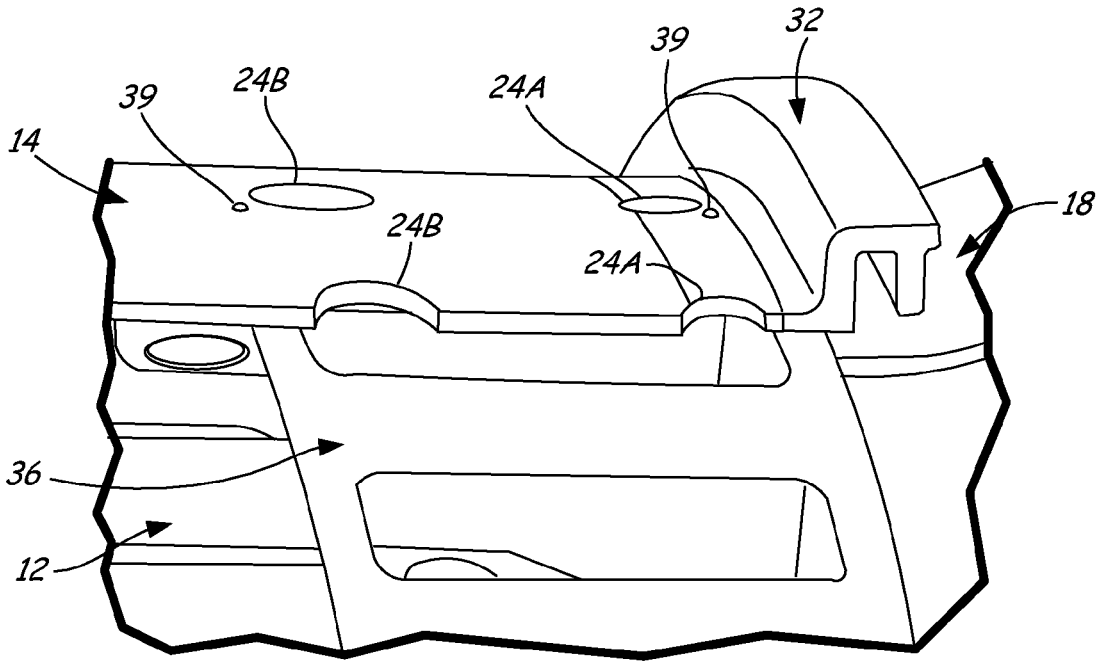
FIG. 1B is an enlarged cross section of the combustor assembly with the baffle ring.

FIGS. 1A and 1B illustrate combustor assembly 10 that includes combustor liner 12, flow sleeve 14, transition duct 16, impingement sleeve 18 and baffle ring 36. Combustor liner 12 is connected to transition duct 16. In use, hot gases, indicated by arrows 20, flow through combustor liner 12, into transition duct 16 and exit combustor assembly 10 through exit 22 to a turbine (not shown).

Flow sleeve 14 surrounds combustor liner 12 and is formed with a plurality of rows of cooling holes 24A, 24B, 24C, 24D (generally referred to as cooling holes 24). First flow annulus 26 is formed between combustor liner 12 and flow sleeve 14. Cooling air enters as jet-like flow into first flow annulus 26 through cooling holes 24, and impinges upon combustor liner 12 to cool it. After impingement, the spent cooling air flows generally parallel to combustor liner 12 in first flow annulus 26. The flow of spent cooling air through first flow annulus 26 is indicated by arrow 27.

Impingement sleeve 18 surrounds transition duct 16. Second flow annulus 28 is formed between transition duct 16 and impingement sleeve 18. Impingement sleeve 18 is formed with a plurality of rows of cooling holes 30. Similar to the impingement of combustor liner 12, cooling air enters second flow annulus 28 through cooling holes 30 and impinges upon transition duct 16 to cool it. After impingement, the spent cooling air flows generally parallel to transition duct 16 in second flow annulus 28. The flow of spent cooling air through second flow annulus 28 is indicated by arrow 29.

Combustor liner 12 and transition duct 16 are connected by sliding seal 34. Flow sleeve 14 and impingement sleeve 18 are connected at sliding joint and piston (seal) ring 32 so that first flow annulus 26 and second flow annulus 28 create a continuous flow path. After impingement on transition duct 16, spent cooling air from second flow annulus 28 continues downstream into first flow annulus 26.

The flow of spent cooling air 27, 29 is opposite the flow of hot gases 20 through combustor liner 12. Therefore, the terms "upstream" and "downstream" depend on which flow of air is referenced. In this application, the terms "upstream" and "downstream" are determined with respect to the flow of spent cooling air 27, 29.

Baffle ring 36 includes a plurality of lands 38 and baffles 40. Baffles 40 extend radially inwards towards combustor liner 12 so that the cooling air flow is closer to combustor liner 12 and the cross flow effects are decreased. In one example, baffle ring 36 is about 25% longer than baffles 40. Lands 38 are located between baffles 40. Lands 38 provide passage for air flow from second flow annulus 28. Baffles 40 and lands 38 may be the same width or may be different widths. In one example, baffles 40 are about one third wider than lands 38.

Baffle ring 36 lies in first flow annulus 26 and surrounds a section of combustor liner 12. Baffle ring 36 is sized to fit against the inner surface of flow sleeve 14 so that lands 38 are in contact with flow sleeve 14.

Baffle ring 36 may be attached to flow sleeve 14 by mechanical fastening means. In one example, two rows of rivets 39 may attach baffle ring 36 to flow sleeve 14. In another example, baffle ring 36 may be welded to flow sleeve 14.

Baffle ring 36 is formed so that when baffle ring 36 is in place, baffles 40 align with cooling holes 24 and lands 38 do not align with cooling holes 24. In use, cooling air flows through cooling holes 24 into baffles 40, and impinges on combustor liner 12. Lands 38 fit against the inner surface of flow sleeve 14. Lands 38 provide flow passage through first flow annulus 26. Lands 38 do not block the air flow from second flow annulus 28 into first flow annulus 26. This prevents a pressure drop between annulus 26 and annulus 28.

Figure 2:
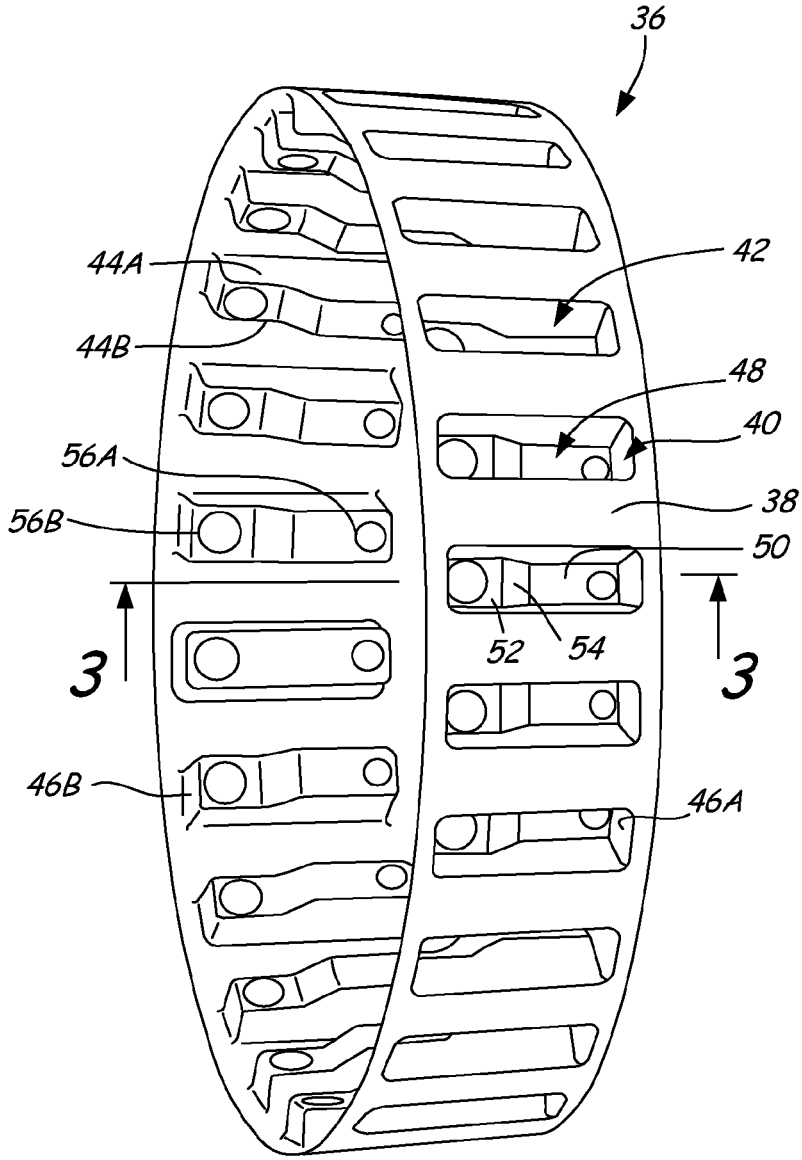
FIG. 2 is a perspective view of the baffle ring.

FIG. 2 shows an enlarged perspective view of baffle ring 36. Baffle ring 36 has a plurality of baffles 40 that extend radially inwards. Each baffle 40 has a pocket 42 defined by sidewalls 44A, 44B, end walls 46A, 46B, and bottom 48. Baffle 40 has upstream section 50, downstream section 52, and transition section 54. "Upstream" and "downstream" are determined with respect to the flow of cooling air through flow annuluses 26, 28.

Sections 50, 52, and 54 may be the same length or may be different lengths. In one example, upstream section 50 is longer than downstream section 52, and downstream section 52 is longer than transition section 54.

At least one baffle cooling hole 56A is formed in each baffle bottom 48. In one example, baffle cooling holes 56A, 56B may be formed in each baffle 40. Baffle cooling holes 56A, 56B (referred to generally as baffle cooling holes 56) may be aligned with cooling holes 24. In one example, baffle cooling hole 56A is aligned with cooling hole 24A and baffle cooling hole 56B is aligned with cooling hole 24B, where cooling hole 24A is adjacent to impingement sleeve 18 and cooling hole 24B is adjacent to cooling hole 24A.

The diameters of baffle cooling holes 56A, 56B depends on the desired cooling flow rate. Larger baffle cooling holes 56A, 56B provide more cooling air to combustor liner 12. The diameter of baffle cooling holes 56A may be the same or different than baffle cooling hole 56B. In one example, baffle cooling hole 56A has a smaller diameter than baffle cooling hole 56B. In another example, baffle cooling hole 56B is about 45% larger in diameter than baffle cooling hole 56A. In another example, baffle cooling hole 56A has a diameter of 0.52 about inches (1.3 cm) and baffle cooling hole 56B has a diameter of about 0.75 inches (1.9 cm).

The diameters of cooling holes 24 may be the same as or may be larger than the diameters of baffle cooling holes 56. In one example, the diameters of cooling holes 24 are larger than the diameters of the baffle cooling holes 56 with which they are aligned so that the smaller baffle cooling holes 56 set the flow resistance and meter the cooling air flowing into first flow annulus 26.

Figure 3:
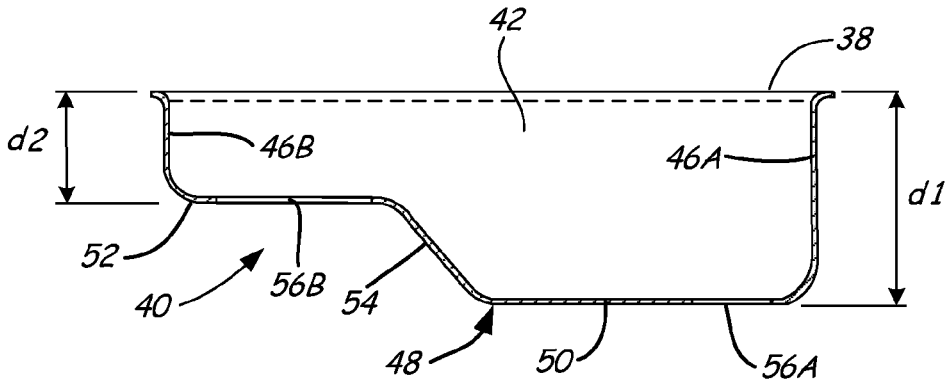
FIG. 3 is a cross section of the baffle taken along line 3-3 of FIG. 2.

FIG. 3 shows a cross section of baffle 40 taken along line 3-3 in FIG. 2. Each baffle 40 has a depth measured from land 38 to baffle bottom 48. Baffle 40 may have a uniform depth throughout or the depth may vary within a single baffle 40. In one example, the depth of baffle 40 varies over the length of baffle 40. Upstream section 50 has depth d1 and downstream section 52 has depth d2. In one example, depth d1 of upstream section 50 is deeper than depth d2 of downstream section 52. In another example, depth d1 is about twice depth d2.

In order to extend between baffle bottom 48 of upstream section 50 and baffle bottom 48 of downstream section 52 when upstream section 50 and downstream section 52 have different depths, baffle bottom 48 of transition section 54 must be at an angle. In one example, baffle bottom 48 of transition section 54 is at about a thirty degree angle to baffle bottom 48 of upstream section 50.

The depth of baffle 40 affects the distance between baffle bottom 48 and combustor liner 12. The greater the depth, the closer baffle bottom 48 is to combustor liner 12. Therefore, baffle bottom 48 of upstream section 50 may be closer to or farther away from combustor liner 12 than baffle bottom 48 of downstream section 52. In one example, baffle bottom 48 of upstream section 50 is closer to combustor liner 12 than baffle bottom 48 of downstream section 52.

Figure 4:
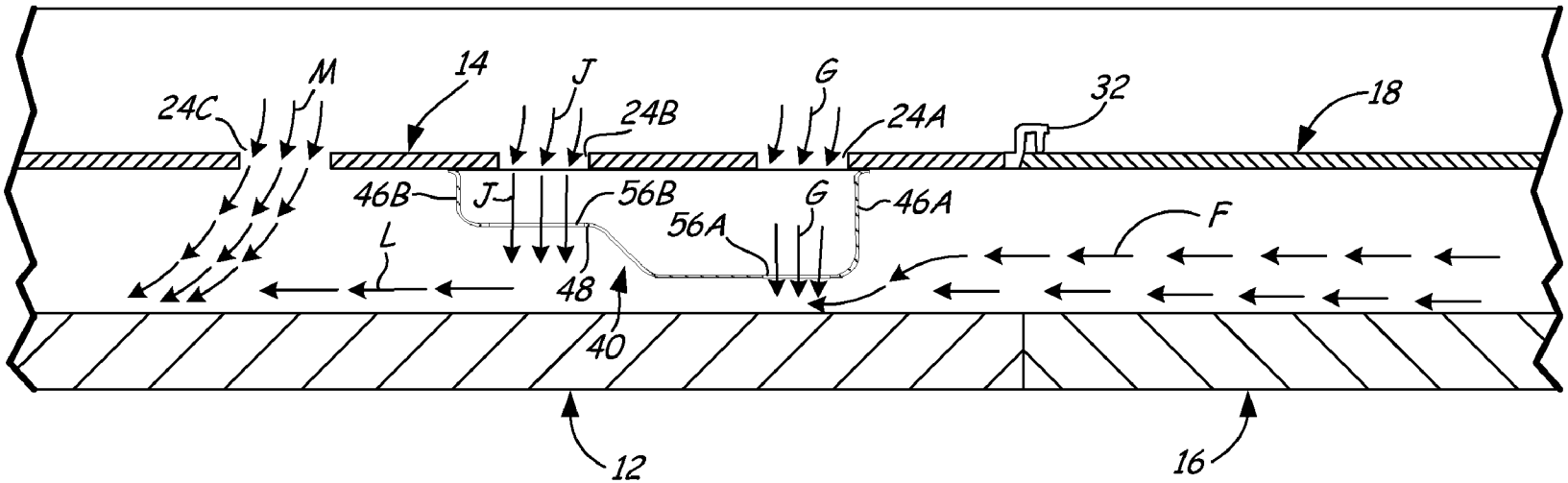
FIG. 4 is a flow diagram illustrating air flow in the combustor assembly of FIG. 1A.

FIG. 4 is a flow diagram illustrating air flow through combustor assembly 10. Air flow F flows from second flow annulus 28 into first flow annulus 26, and cooling air jets G, J and M flow through cooling holes 24 to impingement cool combustor liner 12. As shown, cooling air jet G enters baffle 40 through cooling hole 24A. Cooling air jet G exits baffle 40 through baffle hole 56A and impinges on combustor liner 12. Having baffle hole 56A closer to the liner reduces the cross flow effect on cooling air jet G. Similarly, cooling air jet J enters baffle 40 through cooling hole 24B, exits through baffle hole 56B, and impinges on combustor liner 12. Cooling air jets J and G combine with air flow F to form air flow L. Cooling air L has relatively little effect on downstream cooling air jet M.

Baffle 40 extends into first flow annulus 26 and guides cooling air jets G and J, ensuring that combustor liner 12 is impinged at the desired point. End wall 46A deflects air flow F downward so that the air flows between baffle bottom 48 and combustor liner 12.

As discussed above, upstream section 50 of baffle 40 may be deeper or the baffle bottom 48 of upstream section 50 may be closer to combustor liner 12 than downstream section 52. In this arrangement, upstream section 50 of baffle 40 blocks the cross flow for downstream section 52. Therefore, downstream section 52 does not encounter as much cross flow as upstream section 50 and it is not necessary for downstream section 52 to be as close to combustor liner 12.

Baffle ring 36 is a one-piece assembly. In contrast, prior art assemblies inserted a plurality of individual tubes or conduits into cooling holes 24. In one prior art assembly as many as 48 individual tubes were welding into cooling holes 24. This is expensive and labor intensive. The large number of pieces also increases the probability that a piece will come loose and cause damage to downstream turbine blades and vanes. This is known as foreign object damage (FOD). Baffle ring 36 reduces part count, decreases cost and reduces FOD potential.

Although the present invention has been described with reference to preferred embodiments, workers skilled in the art will recognize that changes may be made in form and detail without departing from the spirit and scope of the invention.

For example, although baffle ring 36 has been described as being part of a new combustor assembly, baffle ring may be added to an existing combustor assembly to provide a more efficient cooling flow to the liner and improve impingement cooling.

The invention claimed is:

1. A combustor assembly for a turbine engine, the combustor assembly comprising:

an annular combustor liner;

a flow sleeve surrounding the combustor liner;

a first annulus defined radially between the combustor liner and the flow sleeve;

a plurality of rows of cooling holes formed in the flow sleeve; and a cooling baffle ring radially surrounding and spaced from the combustor liner in the first annulus for directing air onto the combustor liner, the baffle ring comprising:

a plurality of baffles extending radially inward, each baffle comprising: a pair of side walls, a pair of end walls, a bottom, and a first flow hole formed in the bottom; and a plurality of lands.

2. The combustor assembly of claim 1, wherein each baffle further comprises:

a second flow hole formed in the bottom of the baffle, wherein each baffle is aligned with a flow sleeve cooling hole so that air impinges on the combustor liner.

3. The combustor assembly of claim 2 wherein the first and second flow holes have a smaller diameter than the cooling hole with which the baffle is aligned.

4. The combustor assembly of claim 2 wherein the first and second flow holes have the same diameter as the cooling hole with which the baffle is aligned.

5. The combustor assembly of claim 2, and further comprising:

a transition duct connected to the combustor liner;

an impingement sleeve connected to the flow sleeve and radially surrounding the transition duct; and a second flow annulus radially defined between the transition duct and the impingement sleeve, wherein the baffle ring is positioned in the first flow annulus adjacent to the transition duct for directing air from the second flow annulus to the first flow annulus, and for directing air onto the combustor liner.

6. The combustor assembly of claim 5, wherein the first flow holes are aligned with a first row of cooling holes adjacent the impingement sleeve.

7. The combustor assembly of claim 5, wherein the first flow hole has a first flow hole diameter and the second flow hole has a second flow hole diameter, and wherein the first flow hole diameter is smaller than the second flow hole diameter.

8. The combustor assembly of claim 7, wherein the first flow holes are aligned with a first row of cooling holes adjacent the impingement sleeve.

9. The combustor assembly of claim 5, wherein each baffle has an upstream portion adjacent the impingement sleeve and a downstream portion opposite the upstream portion, and wherein the first flow hole is in the upstream portion and the second flow hole is in the downstream portion, and wherein the first flow hole is closer to the combustor liner than the second flow hole.

10. The combustor assembly of claim 9, wherein the first flow hole has a first flow hole diameter and the second flow hole has a second flow hole diameter, and wherein the first flow hole diameter is smaller than the second flow hole diameter.

11. The combustor assembly of claim 1, wherein the baffle ring is a one-piece assembly.

12. A method of cooling an annular combustor liner, the method comprising:

surrounding the annular combustor liner with a flow sleeve so that a flow annulus is formed between the combustor liner and the flow sleeve, wherein the flow sleeve includes a first row of cooling holes; and radially surrounding the combustor liner with a baffle ring spaced from the combustor liner, wherein the baffle ring comprises a plurality of baffles extending in a radially inward direction, each baffle comprising: a pair of side walls, a pair of end walls, a bottom, and a first flow hole formed in the bottom, and wherein the first flow hole is aligned with the first row of cooling holes; and directing impingement air through the baffle ring onto the combustor liner.

13. The method of claim 12 wherein each cooling hole has a larger diameter than the first flow hole with which it is aligned.

14. The method of claim 12, and further comprising forming a second flow hole in each baffle, wherein the first flow hole has a first flow hole diameter and the second flow hole has a second flow hole diameter, and wherein the first flow hole diameter is smaller than the second flow hole diameter.

15. The method of claim 14 wherein the first flow hole is closer to the combustor liner than the second flow hole.

16. The method of claim 12, wherein the baffle ring is a one-piece assembly.

* * * * *